United States Patent [19]

Siskind

[11] Patent Number: 4,675,272

[45] **Date of Patent: * Jun. 23, 1987**

[54] ELECTROLEVELLED SUBSTRATE FOR ELECTROPHOTOGRAPHIC PHOTORECEPTORS AND METHOD OF FABRICATING SAME

[75] Inventor: Marvin S. Siskind, Farmington Hills, Mich.

[73] Assignee: Energy Conversion Devices, Inc., Troy, Mich.

[ * ] Notice: The portion of the term of this patent subsequent to Apr. 14, 2003 has been disclaimed.

[21] Appl. No.: 793,927

[22] Filed: Nov. 1, 1985

[51] Int. Cl.[4] ..... G03G 5/082

[52] U.S. Cl. ..... 430/131; 430/62

[58] Field of Search ..... 430/62, 63, 65, 64, 430/131

[56] References Cited

U.S. PATENT DOCUMENTS

| | | | |
|---|---|---|---|
| 3,927,463 | 12/1975 | Dupree et al. | 118/644 |
| 4,532,198 | 7/1985 | Saitoh et al. | 430/63 |
| 4,537,846 | 8/1985 | Mimura et al. | 430/63 |
| 4,571,371 | 2/1986 | Yashiki | 430/65 |

*Primary Examiner*—John L. Goodrow

*Attorney, Agent, or Firm*—Marvin S. Siskind; Richard M. Goldman

[57] ABSTRACT

An improved electrolevelled, electrically-conductive substrate for use in the manufacture of electrophotographic photoreceptors and a method of fabricating same.

8 Claims, 4 Drawing Figures

FIG. 1
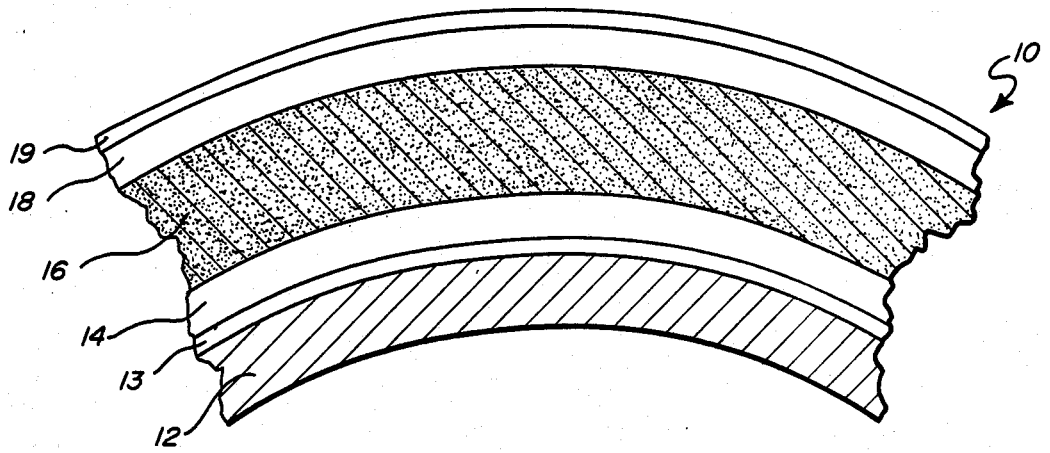
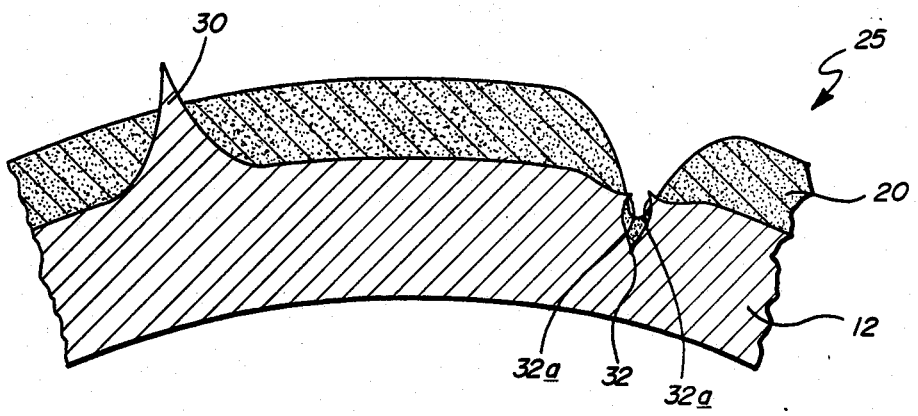
FIG. 2A

FIG. 2B
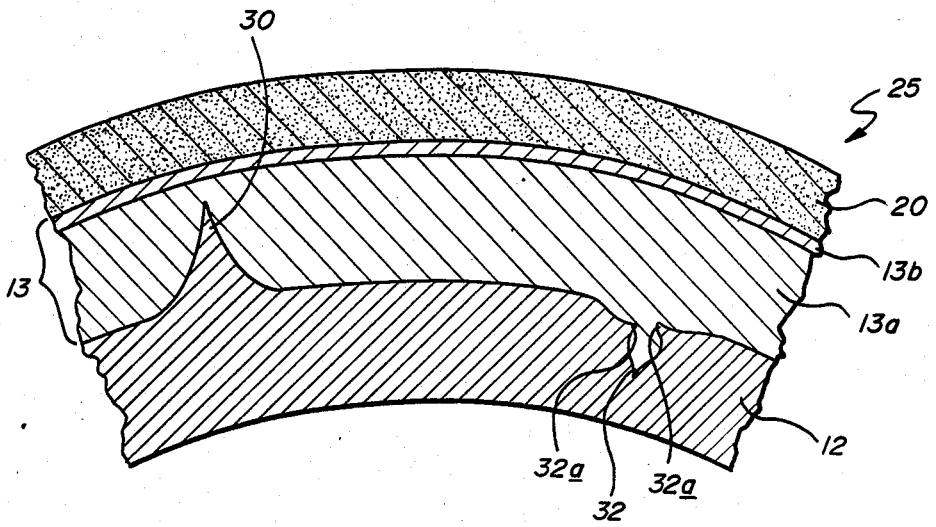
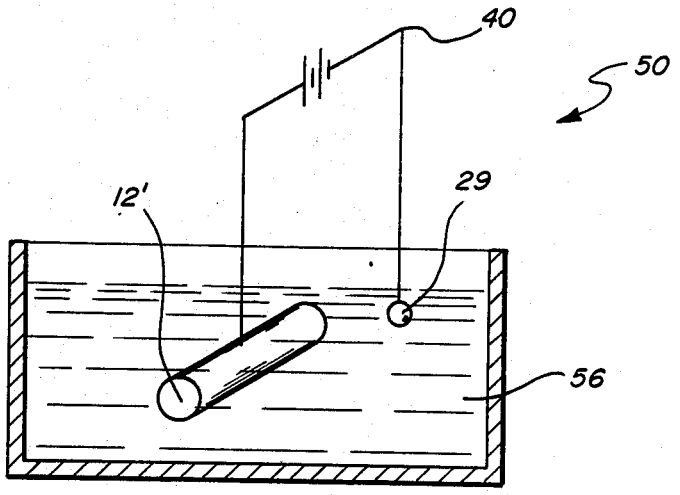
FIG. 3

ELECTROLEVELLED SUBSTRATE FOR ELECTROPHOTOGRAPHIC PHOTORECEPTORS AND METHOD OF FABRICATING SAME

FIELD OF THE INVENTION

This invention relates generally to electrophotographic photoreceptors and more particularly to an improved, electrically conductive substrate which includes a specifically tailored peripheral surface adapted to substantially promote the subsequent deposition of the layers of semiconductor alloy material from which the electrophotographic photoreceptor is fabricated.

BACKGROUND OF THE INVENTION

The instant invention relates to improved electrically conductive substrates specifically designed for use in electrophotographic imaging processes. The improved substrate of the instant invention is fabricated from a non-deformable, electrically conductive metallic material, such as stainless steel, the deposition surface of which is "electrolevelled" so as to be characterized by a decreased number of surface defects, which defects can deleteriously effect the glow discharge deposition of the layers of semiconductor alloy material from which the electrophotographic photoreceptor is fabricated. By so forming the substrate, the morphological growth of the layers of semiconductor alloy material thereupon is improved due to the level, defect-free topology of the deposition surface thereof and the substrate becomes less susceptible to damage.

Electrophotography, also referred to generically as xerography, is an imaging process which relies upon the storage and discharge of an electrostatic charge by a photoconductive material for its operation. A photoconductive material is one which becomes electrically conductive in response to the absorption of illumination; i.e., light incident thereupon generates electron-hole pairs (referred to generally as "charge carriers"), within the bulk of the photoconductive material. It is these charge carriers which permit the passage of an electrical current through that material for discharge of the static electrical charge (which charge is stored upon the outer surface of the electrophotographic media in the typical electrophotographic process).

First the structure and then the operation of a typical xerographic or electrophotographic photoreceptor will be explained so that the operation and advantages of the instant invention may be fully appreciated. It is to be noted, however, that the improved enhancement layer of the instant invention is not limited to use with "typical" photoreceptors, but is equally adapted to be used with any photosensitive material which undergoes a change in any characteristic thereof under the influence of electromagnetic radiation, which characteristic provides for said material to have image reproduction capabilities.

As to the structure: A typical photoreceptor includes a cylindrically-shaped, electrically conductive substrate member, generally formed of a metal such as aluminum. Other substrate configurations, such as planar sheets, curved sheets or metallized flexible belts may likewise be employed. The photoreceptor also includes a photoconductive layer, which as previously described, is formed of a photoresistive material having a relatively low electrical conductivity in the dark and a relatively high electrical conductivity under illumination. Disposed between the photoconductive layer and the substrate member is a blocking layer, formed either by the oxide naturally occuring on the substrate member, or from a deposited layer of semiconductor alloy material. As will be discussed in greater detail hereinbelow, the blocking layer functions to prevent the flow of unwanted charge carriers from the substrate member into the photoconductive layer in which layer they could then neutralize the charge stored upon top surface of the photoreceptor. A typical photoreceptor also generally includes a top protective layer disposed upon the photoconductive layer to stabilize the electrostatic charge acceptance against changes due to adsorbed chemical species and to improve the photoreceptor durability. Finally, a photoreceptor also may include an enhancement layer operatively disposed between the photoconductive layer and the top protective layer, the enhancement layer adapted to substantially prevent charge carriers from being caught in deep traps and hence prevent charge fatigue in the photoreceptor.

In operation of the electrophotographic process: the photoreceptor must first be electrostatically charged in the dark. Charging is typically accomplished by a corona discharge or some other such conventional source of static electricity. An image of the object to be photographed, for example a typewritten page, is then projected onto the surface of the charged electrophotographic photoreceptor. Illuminated portions of the photoconductive layer, corresponding to the light areas of the projected image, become electrically conductive and pass the electrostatic charge residing thereupon through to the electrically conductive substrate thereunder, which substrate is generally maintained at ground potential. The unilluminated or weakly illuminated portions of the photoconductive layer remain electrically resistive and therefore continue to be proportionally resistive to the passage of electrical charge to the grounded substrate. Upon termination of the illumination, a latent electrostatic image remains upon the photoreceptor for a finite length of time (the dark decay time period). This latent image is formed by regions of high electrostatic charge (corresponding to dark portions of the projected image) and regions of reduced electrostatic charge (corresponding to light portions of the projected image).

In the next step of the electrophotographic process a fine powdered pigment bearing an appropriate electrostatic charge and generally referred to as a toner, is applied (as by cascading) onto the top surface of the photoreceptor where it adheres to portions thereof which carry the high electrostatic charge. In this manner a pattern is formed upon the top surface of the photoreceptor, said pattern corresponding to the projected image. In a subsequent step the toner is electrostatically attracted and thereby made to adhere to a charged receptor sheet which is typically a sheet of paper or polyester. An image formed of particles of toner material and corresponding to the projected image is thus formed upon the receptor sheet. In order to fix this image, heat and/or pressure is applied while the toner particles remain attracted to the receptor sheet. The foregoing describes a process which is the basis of many commercial systems, such as plain paper copiers and xeroradiographic systems.

It should be clear from the foregoing discussion that in order to obtain high resolution copies, it is desirable that the electrophotographic photoreceptor accept and retain a high static electrical charge in the dark; it must also provide for the flow of the charge carriers which form that charge from portions of the photoreceptor to the grounded substrate, or from the substrate to the charged portions of the photoreceptor under illumination; and it must retain substantially all of the initial charge for an appropriate period of time in the non-illuminated portions without substantial decay thereof. Image-wise discharge of the photoreceptor occurs through the photoconductive process previously described. However, unwanted discharge may occur via charge injection at the top or bottom surface and/or through bulk thermal charge carrier generation in the photoconductor material.

A major source of charge injection is at the metal substrate/semiconductor alloy material interface. The metal substrate provides a virtual sea of electrons available for injection and subsequent neutralization of, for example, the positive static charge on the surface of the photoreceptor. In the absence of any impediment, these electrons would immediately flow into the photoconductive layer; accordingly, all practical electrophotographic media include a bottom blocking layer disposed between the substrate and the photoconductive member. This bottom blocking layer is particularly important for electrophotographic devices which employ photoconductors with dark conductivities greater than $10^{-13}$ohm$^{-1}$cm$^{-1}$. As mentioned hereinabove, in some cases the blocking layer may be formed by native oxides occuring upon the surface of the substrate, as for example a layer of alumina occuring on aluminum. In other cases, the blocking layer is formed by chemically treating the surface of the substrate. An important class of blocking layers is formed by depositing a layer of semiconductor alloy material of appropriate conductivity type onto the substrate to give rise to blocking conditions.

In order to better understand the manner in which the blocking layers operate, it is necessary to review in greater depth a portion of the physics involved in the blocking layer phenomenon. As previously mentioned, the blocking layer must inhibit the transport and subsequent injection of the appropriate charge carrier (electrons for a positively charged drum) principally from the metal substrate into the body of the photoreceptor. This is accomplished in the doped semiconductor blocking layer by establishing a condition in which the minority charge carrier drift range, mu tau E, is smaller than the blocking layer thickness. Here, mu is the minority carrier mobility, tau is the minority carrier lifetime and E is the electric field strength. One can, for instance, substantially reduce the mu tau product for electrons by doping the blocking layer p-type. The excess holes present in the doped blocking layer greatly increase the probability of electron-hole recombination, thereby reducing the electron lifetime, tau. In effect a condition is achieved whereby electrons injected from the metal substrate recombine with holes in the p-type blocking layer before they are able to drift into the bulk of the photoreceptor to be swept through the top surface and neutralize the static charge thereon. However, while doping can serve to limit the mu tau product for the desired carrier, it can also give rise to deep electronic energy levels in the energy gap of semiconductor alloy material. This is particularly true for semiconductor alloy material, such as amorphous silicon alloys, in which the efficiency of substitutional doping is not high. These deep levels can become the source of thermally generated carriers or they can, if sufficiently numerous, provide a parallel path for the hopping conduction of electrons through the doped layers. Either of these phenomena can serve to compromise the blocking function of the doped layers.

In the course of operation of the typical electrophotographic process, described above, a positive corona charge is placed on the outer surface (the exposed surface of the top protective layer) of the electrophotographic media. The initial reaction of the photoconductive layer of the electrophotographic media to the application of this positive charge to the top surface thereof is to have any free electrons from the bulk be swept toward that surface in an attempt to neutralize the positive charge residing thereon. However, in the movement of these electrons from the bulk of the photoconductive layer to the outer surface of the top protective layer (on which surface the positive charge carriers have accumulated), said electrons encounter deep trap sites such as midgap defect states. While these trap sites are located throughout the bulk of the photoconductive layer, they are of particular importance when they reside near the interface of the photoconductive layer and the top protective layer. This is because the blocking function (the inability of the positive charge carriers electrostatically positioned on the periphery of the top protective layer to penetrate that layer) will cease to be effective (will "breakdown") when an electrical field of sufficient strength is placed across the top protective layer. Obviously, a given density of negative charge carriers trapped near the aforementioned interface of the top protective layer and the photoconductive layer will generate a sufficiently strong electrical field across the top protective layer to cause breakdown, whereas the same number of negative charge carriers trapped in the bulk thereof will not.

Further, trapping sites located deep in the energy gap of a semiconductor alloy material release trapped charge carriers at a much slower rate than do sites located closer to one of the bands. This results from the fact that more thermal energy is required, for example, to re-excite a trapped electron from the deep sites which exist near the middle of the energy gap to the conduction band than is required to re-excite an electron from the shallower sites which exist closer to the conduction band. The slow release rate from deep traps gives rise to a higher equilibrium trap occupancy and thus a higher electric field distribution.

It is important to note that in the fabrication of the typical electrophotographic photoreceptor which operates with a positive corona charge applied to outer surface thereof, the photoconductive layer thereof is made from a "pi-type" silicon:fluorine:hydrogen:boron alloy. As used herein, "pi-type" will refer to semiconductor alloy material, the Fermi level of which has been displaced from its undoped position closer to the conduction band to a position approximately "midgap". Further note that as used herein, the term "midgap" will be used to define a point in the energy gap of a semiconductor alloy material which is positioned approximately half-way between the valence band and the conduction band (in the case of 1.8 eV amorphous silicon:fluorine:hydrogen:boron alloy this is about 0.9 eV from each of the bands). It is necessary to make the photoconductive layer of the photoreceptor pi-type because the typical "intrinsic" amorphous silicon:hydrogen:fluorine alloy as deposited in a glow discharge decomposition process is slightly "nu-type" (the Fermi level of that material is slightly closer to the conduction band than to the valence band) and in a positive corona charge electrophotographic process, the movement of charge carriers through the photoconductive layer under illumination must be maximized while miminizing the thermal generation of charge carriers.

It is to be noted that when the Fermi level is positioned at midgap (as after the addition of the p-dopant to the silicon:fluorine:hydrogen alloy material), electrons moving through said pi-type material will encounter deep traps from which they cannot readily emerge. This is because the deepest electron trap sites in a layer of semiconductor alloy material lie at or near the Fermi level and in this Pi type material this energy coincides with midgap. The thermal energy required to release an electron from a deep trap is dependent on the depth of that trap. For a Fermi level position of 0.9 eV (midgap) the emission time has been calculated to be $4\times10^3$ seconds at room temperature. This slow escape time means that it takes approximately 1.2 hours for an electron to vacate the trap. Obviously, an electrophotographic photoreceptor cannot tolerate such a slow electron discharge rate. If electrons, once trapped, remain confined for such a lengthy period of time, a large concentration of electrons trapped at the photoconductor layer/top protective layer interface will build up and this space charge and the positive charge accumulated on the surface of the top protective layer will create a very high electric field distortion across said top protective layer, which field causes the top protective layer to "breakdown". As used herein, "breakdown" refers to the inability of the top protective layer to inhibit the flow of charge carriers therethrough.

This breakdown phenomena can be eliminated by reducing the number of defect states which give rise to deep charge carrier traps. By positioning of the Fermi level of the semiconductor alloy material from which the enhancement layer is formed to a position above midgap, electrons moving through the enhancement layer do not have to pass through a region in which there are effective deep midgap traps. This translates into an electron escape time of less than about 1 second for a 1.8 eV silicon:hydrogen:fluorine:phosphine alloy having the Fermi thereof positioned in the most favored range of 0.75 to 0.65 eV from the conduction band. Because of the quick release time there will be no substantial build up of trapped charge in this region and therefore no high field distortion.

The semiconductor alloy material of the enhancement layer which is interposed between the photoconductive layer and the top protective layer is phosphorous doped in order to shift the Fermi level thereof toward the conduction band. By so shifting the Fermi level of the semiconductor alloy material, the electrons do not have to move through and become caught in the deep midgap states present in the energy gap thereof. This substantially eliminates the problems of charge fatigue by keeping the electrons out of the deep midgap states. Then both boron dopant and phosphorus dopant are introduced so as to pin the Fermi level at that preselected position in the energy gap through the addition of defect states on both sides of the pinned Fermi level. The added defect states, being shallow, not only solve charge fatigue problems, but those states are sufficiently numerous to inhibit lateral electron flow, quench the field effect and hence simultaneously solve image flow problems.

In light of the many definitions utilized for the terms "amorphous" and "microcrystalline" in the scientific and patent literature it will be helpful to clarify the definition of those terms as used herein. The term "amorphous", as used herein, is defined to include alloys or materials exhibiting long range disorder, although said alloys or materials may exhibit short or intermediate range order or even contain crystalline inclusions. As used herein the term "microcrystalline" is defined as a unique class of said amorphous materials characterized by a volume fraction of crystalline inclusions, said volume fraction of inclusions being greater than a threshold value at which the onset of substantial changes in certain key parameters such as electrical conductivity, band gap and absorption constant occur. It is to be noted that pursuant to the foregoing definitions, the microcrystalline, materials employed in the practice of the instant invention fall within the generic term "amorphous" as defined hereinabove.

The concept of microcrystalline materials exhibiting a threshold volume fraction of crystalline inclusions at which substantial charges in key parameters occur, can be best understood with reference to the percolation model of disordered materials. Percolation theory, as applied to microcrystalline disordered materials, analogizes properties such as the electrical conductivity manifested by microcrystalline materials, to the percolation of a fluid through a non-homogeneous, semi-permeable medium such as a gravel bed.

Microcrystalline materials are formed of a random network which includes low mobility, highly disordered regions of material surrounding randomized, highly ordered crystalline inclusions or grains having high carrier mobility. Once these crystalline inclusions attain a critical volume fraction of the network, (which critical volume will depend, inter alia, upon the size and/or shape and/or orientation of the inclusions), it becomes a statistical probability that said inclusions are sufficiently interconnected so as to provide a low resistance current path through the network. Therefore at this critical or threshold volume fraction, the material exhibits a sudden increase in conductivity. This analysis (as described in general terms relative to electrical conductivity herein) is well known to those skilled in solid state theory and may be similarly applied to describe additional physical properties of microcrystalline materials, such as optical gap, absorption constant, etc.

The onset of this critical threshold value for the substantial change in physical properties of microcrystalline materials will depend upon the size, shape and orientation of the particular crystalline inclusions, but is relatively constant for different types of materials. It should be noted that while many materials may be broadly classified as "microcrystalline" those materials will not exhibit the properties Applicants have found advantageous for the practice of the subject invention unless they have a volume fraction of crystalline inclusions which exceeds the threshold value necessary for substantial change. Accordingly, we have defined "microcrystalline materials" to include only those materials which have reached the threshold value. Further note that the shape of the crystalline inclusions is critical to the volume fraction necessary to reach the threshold value. There exist 1-D, 2-D and 3-D models which predict the volume fraction of inclusions necessary to reach the threshold value, these models being dependent on the shape of the crystalline inclusions. For instance, in a 1-D model (which may be analogized to the flow of charge carriers through a thin wire), the volume fraction of inclusions in the amorphous network must be 100% to reach the threshold value. In the 2-D model (which may be viewed as substantially conically shaped inclusions extending through the thickness of the amorphous network), the volume fraction of inclusions in the amorphous network must be about 45% to reach the threshold value. And finally in the 3-D model (which may be viewed as substantially spherically shaped inclusions in a sea of amorphous material), the volume fraction of inclusions need only be about 16–19% to reach the threshold value: *Therefore, amorphous materials, (even materials classified as microcrystalline by others in the field) may include crystalline inclusions without being microcrystalline as that term is defined herein.*

Now that the structure and operation of a typical electrophotographic photoreceptor has been defined, it is possible to introduce the problem solved by the subject application, namely the problem of improving the morphological growth of semiconductor alloy material upon the deposition surface of a metallic substrate, such as an electrophotographic drum or web. In analyzing this problem, it is necessary to take into consideration the fact that the semiconductor alloy material must be deposited to a thickness which exceeds 25 microns and any surface imperfections on the substrate will drastically and deleteriously affect the growth of that material. The subject invention solves this problem of morphological growth by greatly reducing the number of surface defects so as to provide a morphologically level deposition surface upon which to grow said "thick" layers of semiconductor alloy material. The term "thick" has been placed in quotation marks because the total thickness of the layers of deposited semiconductor alloy material typically falls into the range of 15–30 microns (not much thicker than a human hair). Therefore, a surface defect can easily be propagated, and manifest its presence, through the entire thickness of the deposited layers of semiconductor alloy material. And even if the defect is not of sufficiently great size to be seen through those layers of material, it can still form a weak spot in the subsequently deposited semiconductor alloy material, said weak spot initiated by columnar growth which represents the preferred growth mechanism at defect sites. The columnar growth has a tendency to crack or peel when subjected to shear forces which occur when the electrophotographic photoreceptor is operatively employed and subjected to the abrasive force of copier paper continuously rolled thereagainst, the response of said weak spots to said continuous abrasion is to crack, which cracking results in the phenomenon known as "white spotting" in the copies made from such a photoreceptor.

Despite the use of the highest quality metals, such as aluminum or stainless steel to serve as the substrate or base electrode upon which the semiconductor material is deposited, it has been estimated that from 10,000 to 100,000 surface defects, i.e., irregularities, per square centimeter are present on the deposition surface thereof. Such irregularities take the form of projections, craters, or other deviations from a smooth finish, and may be under a micron in (1) depth below the surface, (2) height above the surface, or (3) diameter. Depending upon their configuration, size, the sharpness with which the irregularities deviate from a smooth surface finish, and the manner in which the semiconductor alloy material covers or fails to cover the defect, a weakened path through the semiconductor alloy material may be established, thereby effectively preventing the attainment of good blocking conditions, promoting white spotting and generally contributing to low saturation voltage capabilities in electrophotographic devices which has been fabricated thereupon. This may occur in numerious ways. For instance, a spike projecting from the surface of the substrate may be of too great a height to be covered by the subsequent deposition of the layers of semiconductor alloy material. Likewise, a crater formed in the surface of the substrate electrode may be of too large a diameter or too large a depth to be filled by the subsequent deposition of the layers of semiconductor alloy material. Note that even if the size of the defect (its deviation from a smooth surface) is not very large, but it includes one or more sharp or jagged features, said defect is still capable of causing the deposited semiconductor alloy material to be of less than optimum quality. This is because the sharp features of even small defects are capable of forming nucleation centers which promote nonhomogeneous and nonuniform growth of the deposited semiconductor alloy material, and (3) due to their presence, tend to initiate columnar growth which gives rise to the aforementioned weak spots.

Therefore, the instant invention is concerned with the elimination of defects which (1) due to the size thereof, cannot be adequately covered by the subsequent deposition of layers of that semiconductor alloy material, and (2) due to the sharp features thereof, inhibit the deposition of homogeneous, uniform layers of that semiconductor alloy material.

The instant invention, as will be described in greater detail hereinbelow, provides for the fabrication of electrophotographic photoreceptors which include an easily deposited substrate levelling layer for substantially eliminating surface defects inherently present in said substrates. More particularly, photoreceptor devices produced in accordance with the principles outlined by the subject disclosure are characterized by reduced white spotting and improved saturation voltage, which properties are achieved through the utilization of an electrolevelled substrate characterized by a substantial reduction of surface irregularities.

According to the principles of the preferred embodiment of the instant invention, a continuous, relatively thick, electrically conductive "levelling layer" is electroplated onto the deposition surface of the substrate so as to be operatively disposed between that substrate and the subsequently deposited body of semiconductor alloy material. This levelling layer functions to provide a smooth, substantially defect free deposition surface for that body of semiconductor alloy material. In this manner, the subsequently deposited body of semiconductor alloy material is able to uniformly, homogeneously and continuously cover the substrate, thereby substantially reducing problems associated with poor growth characteristics of the semiconductor alloy material. Accordingly, the instant invention provides an economical method for the manufacture of improved amorphous silicon, alloy based, thin film, large area electrophotographic photoreceptors characterized by substantially reduced white spotting, excellent current blocking capabilities, and hence by very high saturation voltages.

Yet another advantage can be derived from the utilization of the electrolevelled substrate of the subject invention. The material of choice from which metallic, electrically conductive substrates for electrophotographic photoreceptors are fabricated is aluminum. Aluminum is routinely employed because of the fact that it can be easily diamond polished so as to provide a high quality surface finish characterized by a relatively low number of surface defects. However, even the number of surface defects present on the surface of aluminum substrates is sufficiently high to cause the aforementioned problems with the morphological growth of the subsequently deposited layers of semiconductor alloy material. As discussed hereinabove, the levelling layer disclosed herein is capable of effectively removing a substantial percentage of the surface defects present on the surface of metallic substrate. Therefore, electrophotographic photoreceptors need no longer be fabricated from a material capable of being diamond polished.

Aluminum suffers from yet a further disadvantage, i.e., the fact that it is a relatively soft metal which is easily deformable. As a consequence of the commercial production and distribution of electrophotographic photoreceptors produced on aluminum drums, it has been found that said aluminum substrates are readily deformable and are unable to withstand the rough treatment inherent in the distribution of said photoreceptors. Prior to the instant invention, owing to the unavailability of a suitable alternative to the soft aluminum substrates, manufacturers of electrophotographic photoreceptors have been unable to fabricate said receptors from other, more durable metals.

However, through the application of the principles enunciated in the disclosure of the subject invention, it is now possible to fabricate electrophotographic photoreceptors from other, less expensive, more durable substrates which are subsequently electrolevelled. The result is the manufacture of a less expensive, very durable photoreceptor which also exhibits reduced stress in the deposited semiconductor alloy material and higher saturation voltages than were previously possible to attain in electrophotographic photoreceptors fabricated from aluminum substrates.

These and other advantages of the instant invention will become apparent from the drawings, the detailed description of the invention and the claims which follow.

BRIEF SUMMARY OF THE INVENTION

There is disclosed herein an improved substrate for an electrophotographic photoreceptor which includes an electrically conductive, metal having a deposition surface thereupon. A blocking layer is disposed in overlying relationship to the deposition surface of the substrate for substantially preventing charge injection from the substrate and a photoconductive layer is deposited in overlying relationship to the blocking layer for discharging charge on the top surface of the photoreceptor. A top layer overlies the photoconductive layer for protecting the photoconductive layer from ambient conditions and a continuous, electrically conductive levelling layer is electroplated atop the deposition surface of the substrate so as to present a substantially defect-free surface for the subsequent deposition thereonto of successive homogeneous bodies of semiconductor alloy material. The levelling layer is formed primarily from a material chosen from the group consisting essentially of nickel, copper, indium, tin, cadmium, zinc; and mixtures thereof.

The levelling layer includes minor quantities of a material deposited from an electroplating bath, said layer including minor quantites of an additive adapted to selectively retard the rate of deposition of the primary material at those defect regions of the substrate which provide the highest current density, thereby providing for the deposition of a smooth, substantially defect-free levelling layer.

The photoreceptor preferably further includes an enhancement layer operatively disposed between the photoconductive layer and the top protective layer, said enhancement layer adapted to prevent charge fatigue.

The levelling layer has a thickness of about 5 microns to 5 mils. In a preferred embodiment, the substrate may be formed of stainless steel and the levelling layer is formed of a nickel or copper alloy electroplated atop the deposition surface thereof. Also, in the preferred embodiment, the enhancement layer may be fabricated from a material selected from the group consisting essentially of amorphous silicon alloys, amorphous germanium alloys and amorphous silicon-germanium alloys. Finally, the photoconductive layer may be fabricated from materials selected from the group consisting essentially of chalcogens, amorphous silicon alloys, amorphous germanium alloys, amorphous silicon-germanium alloys and organic photoconductors.

There is also disclosed herein a method of fabricating an improved substrate for an electrophotographic photoreceptor, the photoreceptor including an electrically conductive substrate having a deposition surface, a blocking layer overlying the deposition surface of the substrate, a photoconductive layer overlying the blocking layer and a top protective layer overlying the photoconductive layer. The method includes the steps of providing an electrically conductive substrate, electroplating a level, continuous, substantially defect-free layer of electrically conductive material atop the deposition surface of the substrate, and glow discharge depositing successive layers of amorphous semiconductor alloy material of varying composition atop the levelling layer so as to form the blocking layer, the photoconductive layer and the top protective layer thereupon. In said method, the levelling layer may be formed from a material selected from the group consisting essentially of nickel, copper, indium, tin, cadmium, zinc and mixtures thereof. The levelling layer is preferably formed in an electroplating bath which includes minor quantities of an additive adapted to selectively retard the rate of deposition of the primary material at those defect regions of the substrate which provide the highest current density, thereby providing for the deposition of a smooth levelling layer of about 5 microns to 125 microns thickness.

The method includes the further step of glow discharge depositing an enhancement layer in operable disposition between the photoconductive layer and the top protective layer. In a still further step, the substrate is preferably formed from stainless steel and the levelling layer is formed of an electroplated nickel or copper alloy.

BRIEF DESCRIPTION OF THE DRAWINGS

FIG. 1 is a partial cross-sectional view of an electrophotographic photoreceptor which includes the improved levelling layer of the instant invention; and FIG. 2A is a cross-sectional view illustrating surface defects formed in the substrate of a semiconductor device which does not incorporate the levelling layer of the instant invention;

FIG. 2B is a cross-sectional view of the semiconductor device of FIG. 2A illustrating the levelling layer of the instant invention (said leveling layer including a compatibility layer) operatively disposed atop the deposition surface of the substrate so as to substantially eliminate the deletorious effects of surface defects; and FIG. 3 is a cross-sectional, diagramatic view of an electroplating assembly in which the electrolevelling process of the subject invention may be accomplished.

BRIEF DESCRIPTION OF THE DRAWINGS

I. The Photoreceptor

Referring now to FIG. 1, there is illustrated in a partial cross-sectional view, a generally cylindrically shaped electrophotographic photoreceptor 10 of the type incorporating all of the innovative principles disclosed within the specification of the instant invention. The photoreceptor 10 includes a generally cylindrically shaped substrate 12 formed, in this embodiment, of stainless steel, although other nondeformable metals (or even deformable metals such as aluminum) could also be effectively employed.

Whereas, it was previously necessary to provide the circumference of the stainless steel substrate 12 with a smooth, substantially defect free surface by any well known technique such as diamond machining and/or polishing, the electrolevelled layer 13 of the instant invention obviates the need for such polishing steps. Disposed immediately atop the deposition surface of the electrolevelled layer 13 is deposited a doped layer 14 of microcrystalline semiconductor alloy material which has been specifically designed and adapted to serve as the bottom blocking layer for said photoreceptor 10. In keeping with the teachings disclosed in commonly assigned U.S. patent application Ser. No. 729,701 filed May 2, 1985, the blocking layer 14 is formed of highly doped, highly conductive microcrystalline semiconductor alloy material. Disposed immediately atop the bottom blocking layer 14 is the photoconductive layer 16 which may be formed from a wide variety of photoconductive materials. Among some of the preferred materials are doped intrinsic amorphous silicon alloys, amorphous germanium alloys, amorphous silicon-germanium alloys, chalcogenide materials and organic photoconductive polymers. Disposed atop the photoconductive layer 16 is the enhancement layer 18, said enhancement layer 18 specifically designed to substantially reduce the problem of charge fatigue described in commonly assigned U.S. patent application Ser. No. 769,106 filed Aug. 26, 1985. Finally, the photoreceptor 10 includes a top protective layer 19 operatively disposed atop the enhancement layer 18, which protective layer 19 (1) protects the upper surface of the photoconductive layer 16 from ambient conditions and (2) separates the charge stored on the surface of the photoreceptor 10 from carriers generated in the photoconductive layer 16.

The enhancement layer 18 is formed of an intentionally doped semiconductor alloy materials. The purpose of intentionally doping the enhancement layer 18 is to move the Fermi level closer to the conduction band (in the case of a positive corona charge) of the semiconductor alloy material from which said layer is fabricated. Obviously, in the case of a negative surface charge, it would be desirable to intentionally dope the enhancement layer 18 so as to move the Fermi level of the semiconductor alloy material from which it is fabricated closer to the valence band. A wide variety of semiconductor alloy materials may be employed from which to fabricate the enhancement layer 18. Among some of the favored materials are silicon:hydrogen alloys, germanium:hydrogen:halogen alloys, germanium:hydrogen alloys, germanium:hydrogen:halogen alloys, silicon:germanium:hydrogen alloys, and silicon:hydrogen:halogen alloys. Among the halongenated materials, fluorinated alloys are particularly preferred. Some such alloys having utility herein are disclosed in U.S. Pat. No. 4,217,374 of Ovshinsky, et al entitled Amorphous Semiconductors Equivalent to Crystalline Semiconductors, U.S. Pat. No. 4,226,898 of Ovshinsky, et al entitled Amorphous Semiconductors Equivalent to Crystalline Semiconductors Produced By A Glow Discharge Process and U.S. patent application Ser. No. 668,435 filed Nov. 5, 1984 of Yang, et al entitled Boron Doped Semiconductor Materials and Method For Producing Same. These patents and applications are assigned to the assignee of the instant invention and the disclosures thereof are incorporated herein by reference.

Doping of the semiconductor alloy material may be accomplished by any technique and employing any material which is well known to those of ordinary skill in the art. Because Applicants' previously fabricated enhancement layer was prepared with a reduced density of defect states, the charge carriers moving through that layer from the photoconductive layer 16 to neutralize charge located at the surface of the top protective layer 19 were not caught in as many deep midgap traps. The result was a reduction in the number of carriers which required the aforedescribed lenghty period of time required to be emitted from the deep traps. By employing an enhancement layer 18, the Fermi level of which is moved to a desired location and pinned so that charge carriers are able to avoid the deep midgap states present in the silicon alloy material from which the layer is fabricated, the residency time of charge carriers caught in traps is significantly decreased since the only traps accessible to the carriers are shallow traps. The absence of deep trapped carriers not only prevents a breakdown of the top protective layer 20, but significantly increases the cycle time in which the electrophotographic medium 10 is capable of recovering lost surface charge and readying itself for reproducing a further copy.

While a wide variety of semiconductor materials may be employed from which to fabricate the photoconductive layer 16, the amorphous silicon alloys, amorphous germanium alloys and amorphous-silicon germanium alloys were found to be particularly advantageous. Such alloys and methods for their preparation are disclosed in the patents and applications referred to and incorporated by reference hereinabove.

The conductivity type of the materials from which the blocking layer 14 and the photoconductive layer 16 are fabricated, are chosen so as to establish a blocking contact therebetween whereby injection of unwanted charge carriers into the bulk of the photoconductive layer 16 is effectively inhibited. In cases where the photoreceptor 10 is adapted to be electrostatically charged with a positive charge, the bottom blocking layer 14 will preferably be fabricated from a heavily p-doped alloy and the photoconductive layer 16 will be fabricated from an intrinsic semiconductor layer, an n-doped semiconductor layer or a lightly p-doped semiconductor layer. Combinations of these conductivity types will result in the substantial inhibition of electron flow from the substrate 12 into the bulk of the photoconductor layer 16. It should be noted that intrinsic, or lightly doped semiconductor layers are generally favored for the fabrication of the photoconductive layer 16 insofar as such materials will have a lower rate of thermal charge carrier generation than will more heavily doped materials. Layers of intrinsic semiconductor alloy materials are most preferably favored insofar as such layers have the lowest number of defect states per unit volume and the most favorable discharge characteristics.

In cases where the electrophotographic photoreceptor 10 is adapted for a negative charging, it will be desirable to prevent the flow of holes into the bulk of the photoconductive layer 16. In such instances the conductivity types of the layers of semiconductor alloy material referred to hereinabove will be reversed, although obviously, intrinsic materials will still have significant utility.

The maximum electrostatic voltage (saturation voltage) which the photoreceptor 10 can sustain $V_{sat}$) will depend upon the efficiency of the blocking layer 14 as well as the thickness of the photoconductive layer 16. For a given blocking layer efficiency, a photoreceptor 10 having a thicker photoconductive layer 16 will sustain a greater voltage. For this reason, charging capacity or charge acceptance is generally referred to in terms of volts per micron thickness of the photoconductive layer 16. For economy of fabrication and elimination of stress it is generally desirable to have the total thickness of the photoconductive layer 16 be 25 microns or less. It is also desirable to have as high a static charge maintained thereupon as possible. Accordingly, gains in barrier layer efficiency, in terms of volts per micron charging capacity, translate directly into improved overall photoreceptor preformance. It has routinely been found that photoreceptors structured in accordance with the principles of the instant invention are able to sustain voltages of greater than 50 volts per micron on up to a point nearing the dielectric breakdown of the semiconductor alloy material.

The intentionally doped semiconductor alloy material of the enhancement layer 18 may be produced from a wide variety of deposition techniques, all of which are well known to those skilled in the art. Said deposition techniques include, by way of illustration, and not limitation, chemical vapor deposition techniques, photoassisted chemical vapor deposition techniques, sputtering, evaporation, electroplating, plasma spray techniques, free radical spray techniques, and glow discharge deposition techniques.

At present, glow discharge deposition techniques have been found to have particular utility in the fabrication of the enhancement layer 18. In glow discharge deposition processes, a substrate is disposed in a chamber maintained at less than atmospheric pressure. A process gas mixture including a precursor of the semiconductor alloy material (and dopants) to be deposited is introduced into the chamber and energized with electromagnetic energy. The electromagnetic energy activates the precursor gas mixture to form ions and/or radicals and/or other activated species thereof which species effect the deposition of a layer of semiconductor material upon the substrate. The electromagnetic energy employed may be dc energy, or ac energy such as radio frequency or microwave energy. Such glow discharge techniques are detailed in said patent applications, incorporated by reference hereinabove. Of course, it is to be understood that microwave energy has been found particularly advantageous for the fabrication of electrophotographic photoreceptors insofar as it allows for the rapid, economical preparation of successive layers of high quality semiconductor alloy material.

II. The Defects and Defect Regions

The surface defects which exist on the circumference of the substrate 12 of the electrophotographic photoreceptor 10 are best illustrated in FIGS. 2A and 2B wherein a crater-type defect 32 or a protuberance-type defect 30 upset the uniform, homogeneous growth pattern of the depositing layer of semiconductor alloy material 20. The instant invention provides for a substantially defect free deposition surface upon the large area substrate 12 so as to substantially eliminate the morphologically deleterious growth and nucleation effects initiated by said surface defects.

The formation and effect of said surface defects will be better understood by specific reference to FIG. 2A which illustrates a layer of semiconductor alloy material deposited upon a substrate 12 *not* provided with the levelling layer of the instant invention. As mentioned hereinabove, the first defect region of the substrate 12 is depicted by a raised protuberance or spike 30 associated with and extending from the deposition surface thereof. This raised protuberance 30 may result from, inter alia, (1) metallurgical irregularities such as impurities, inclusions, columnar growth, etc. in the material from which the substrate 12 is formed, (2) mechanical damage due to nicks, abrasions, etc. occuring during handling of the substrate 12, or (3) particles of dust or other particulate matter contaminating the surface of the substrate 12 during handling, processing, etc. thereof. The protuberance 30 is of sufficient height so as to be either incompletely or inadequately covered by the subsequently deposited layer of semiconductor alloy material 20, or forms a nucleation center which promotes the nonhomogeneous, nonuniform and stressed deposition of that semiconductor alloy material. In this manner, a defect region is formed in the immediate vicinity of the protuberance 30. Obviously, where such defect regions occur in a semiconductor device, nonhomogeneous, nonuniform and stressed layers of semiconductor alloy material are deposited, said layers being so characterized because of the presence of defect regions which serve as nucleation centers for the growth of that semiconductor alloy material.

A second illustrated defect region of the substrate 12 is formed in the immediate vicinity of the crater, generally 32. As herein defined, "craters" will be defined as depressions which include one or more sharp features, said depression formed in the deposition surface of the substrate 12. If the crater is sufficiently large, it becomes very difficult to cover with subsequently deposited layers of semiconductor alloy material or those layers of deposited semiconductor alloy material may exhibit a marked increase in stress resulting in the peeling and cracking of the material from the substrate. Such craters 32, which may also be referred to as pin holes or pits, may be formed by (1) metallurgical or chemical irregularities in the surface of the substrate 12, or (2) mechanical damage due to nicks, abrasions, etc. occurring during handling of the substrate 12. Regardless of how the crater 32 originates, the sharply defined features **32*a* of the craters 32** may form nucleating centers causing the subsequent deposition of said highly stressed, nonhomogeneous, nonuniform semiconductor alloy material. More particularly, surfaces of the substrate which include defects are likely to provoke short circuit current flow through the layers of semiconductor alloy material, promote nonhomogeneous semiconductor growth, and generally cause impaired performance of the electrophotographic photoreceptors with which they are associated.

III. The Levelling Layer

Referring now to FIG. 2B, the levelling layer 13 of the instant invention is shown operatively disposed between the layer of semiconductor alloy material 20 and the substrate 12 of the electrophotographic device 25. The deposition surface of the substrate 12 of said device 25 includes surface defects such as the sharply featured protuberance 30 and multi-sharply featured crater 32. As clearly depicted in FIG. 2B, by incorporating the levelling layer 13, the surface defects are prevented from deleteriously effecting the subsequently deposited layer of semiconductor alloy material 20.

In order to accomplish a levelling function, it is necessary that the levelling material (nickel in the preferred embodiment) be deposited atop the deposition surface of the electrically conductive substrate (stainless steel, mild steel, or aluminum in the preferred embodiment) 12 to a thickness which is sufficiently great to cover the tallest protuberance rising above the surface thereof. It has been determined that at least a 5 micron and preferably a 5 to 12 micron deposition thickness of the nickel alloy plating material 13*a* is sufficient to smooth the deposition surface of the substrate 12 so as to form a substantially defect-free surface upon which the thin film layers of semiconductor alloy material can then be uniformly deposited. It should be noted that following the deposition of the, for instance, nickel alloy plating, a thin compatability layer of a material 13*b* is deposited to (1) protect the surface finish of the nickel levelling layer, and (2) render the deposition surface thereof compatible (adhesive) with the subsequently deposited layers of semiconductor alloy material.

FIG. 3 depicts an electroplating station 50 which has been specifically adapted to electroplate the levelling layer 13 of the instant invention onto the peripheral surface of a cylindrically shaped drum of stainless steel 12'. The station 50 includes a tank 54 containing a bath of nickel alloy plating solution 56 therein. The drum 12' is submerged into the plating solution 56 by a mechanical arm 58. Electrical contact is made with the deposition surface of the drum 12' through that mechanical arm which is electrically connected to a power source, such as battery 40. The electrical circuit is completed by means of an electrode 29 immersed into the plating solution 56. As previously described, the composition of the plating solution 56, the quantity and polarity of the plating current, and the composition of the electrode 29 is dependent upon the material being plated onto the substrate (the drum 12').

It should be noted that the nickel plating procedure of the instant invention (as with any electroplating procedure) is current dependent. More particularly, the plating solution 56 includes a minor quantity of an additive which is adapted to inhibit the deposition of metal upon those portions of the deposition surface of the substrate 12 which exhibit the highest current density. Of course, it is the sharply defined features 32*a* of the crater 32 or the jagged or pointed tips of the protuberances 30, vis-a-vis, more uniformly curved defects, which exhibit the highest current densities. Accordingly, it is the plating of the sharply defined features which is inhibited by the additive. The function of this additive is to lower the current density at these sharply defined features, so as to prevent the most rapid nickel alloy plating from occurring thereat (since the nickel alloy plating is also current dependent), and thereby providing for a substantially level layer of the nickel alloy to cover the defect surface of the substrate 12. Further, by paying particular attention to the most sharply defined defects, those surface irregularities of the substrate 12 which are most likely to cause problems in the subsequent growth of the layers of semiconductor alloy material by forming nucleation centers, have at least been more uniformly rounded, if not totally covered. The result is a substantially defect free deposition surface on which uniform, homogeneous, stress-relieved semiconductor alloy material may subsequently be deposited.

While the foregoing describes one preferred embodiment of the electroplating process of the instant invention in general terms, the following example will serve to more fully demonstrate the operation of, and advantages derived from employing the electrolevelling layer of the instant invention.

EXAMPLE

Nickel was electroplated to a preselected thickness of twelve microns over the entire deposition surface of a test sample of bright-annealed stainless steel (430 alloy) substrate in accordance with the following procedure. Cleansing was accomplished by first moving the substrate through a mild detergent solution having a pH of approximately 8. After three minutes of immersion in the detergent solution, the substrate was guided through a bath of deionized cold water to rinse. The substrate was then soaked in a hydrochloric acid bath (50% by volume concentrated hydrochloric acid) at room temperature, after which the substrate was passed through a further bath containing one pound per gallon of Isoprep 192, 20% by volume concentrated hydrochloric acid plus ½ ounce per gallon of ammonium bifluoride. A cold water rinse then followed. This was followed by a one minute immersion in a room temperature bath of 100 grams per liter of sulfamic acid. Electrical contact was then made to the deposition surface of the substrate by utilizing an electrically conductive guide roller for providing a current of 40 amps per square foot. The substrate was then immersed, for three minutes, into a nickel alloy plating bath #829 at a current density of 70 amps per square foot. The nickel alloy plating bath #829 is a commercially available product supplied by the Allied-Kelite Division of the Witco Chemical Company. After a cold water rinse, the substrate was passed through a nickel sulfamate bath for 10 seconds followed by a cold water rinse. The substrate was then dipped into a room temperature bath of Isoprep 192 followed by another cold water rinse. Finally, the substrate was moved through a chrome plate bath for three minutes at a current of 200 amps per square foot. The electroplated nickel alloy layer thus deposited onto the stainless steel substrate was homogeneous, and exhibited good adhesion, a smooth, level surface, showed reduced signs of columnar growth and was approximately 5 microns thick.

It should be noted that the additives found in the nickel plate bath #829 operated to retard the deposition of the nickel alloy levelling material at those defect sites of the highest current densities, such as the tips of protuberances which rise above the deposition surface of the electrically conductive substrate and the sharply defined features of craters which fall below the deposition surface of the electrically conductive substrate. The result is that a nickel alloy levelling layer is fabricated atop the substrate upon which level, uniform, homogeneous thin film layers of high quality amorphous semiconductor alloy material may be subsequently deposited.

While the foregoing example describes the use of a nickel alloy plating bath, other plating baths of electrically-conductive alloys could also be employed in a similar manner for electroplating those conductive alloys onto the deposition furface of either a stainless steel or aluminum substrate. The only requirement is that the deposited material provide a smooth, level substrate which is substantially free of surface defects and compatible with the subsequently deposited semiconductor alloy material. As mentioned previously, stainless steel or a like metal is a preferred conductive metal because of its nondefomability as compared to aluminum.

The foregoing description and examples are merely illustrative of the utility of the instant invention, and are not intended as limitations thereon. It is the claims which follow, including all equivalents, which define the scope of the invention.

I claim:

1. A method of fabricating an improved substrate for an electrophotographic photoreceptor, said photoreceptor including an electrically conductive substrate having a deposition surface, a microcrystalline silicon alloy blocking layer overlying the deposition surface of the substrate, a photoconductive layer of silicon alloys, germanium alloys or silicon-germanium alloys overlying the blocking layer and a top protective layer overlying the photoconductive layer; the method including the steps of:

providing an electrically conductive substrate;

electroplating a continuous, substantially defect-free levelling layer of electrically conductive material atop the deposition surface of the substrate; said levelling layer including an additive adapted to selectively retard the rate of deposition of said levelling layer at those regions of the substrate which exhibit the highest current density; and glow discharge depositing successive layers of semiconductor alloy material of varying compositions atop the levelling layer so as to form the blocking layer, the photoconductive layer and the top protective layer thereupon.

2. A method as in claim 1, including the further step of forming the levelling layer from a material selected from the group consisting essentially of nickel, copper, indium, tin, cadmium, zinc and mixtures thereof.

3. A method as in claim 1, including the further step of glow discharge depositing an enhancement layer operatively disposed between the photoconductive layer and the top protective layer.

4. A method as in claim 1, including the further step of depositing the levelling layer to a thickness of about 5 microns to 125 microns.

5. A method as in claim 1, including the further step of forming the substrate from stainless steel.

6. A method as in claim 5, including the further step of forming the levelling layer of an electroplated nickel or copper alloy.

7. A method as in claim 3, including the further step of fabricating the enhancement layer from a material selected from the group consisting essentially of amorphous silicon alloys, amorphous germanium alloys and amorphous silicon-germanium alloys.

8. A method as in claim 1, including the further step of fabricating the photoconductive layer from a material selected from the group consisting essentially of chalcogens, amorphous silicon alloys, amorphous germanium alloys, amorphous silicon-germanium alloys and organic photoconductors.

* * * * *